United States Patent [19]

Worrell, Sr. et al.

[11] 4,192,420

[45] Mar. 11, 1980

[54] FLEXIBLE AND PLIABLE MOISTURE-IMPERVIOUS PACKAGE

[75] Inventors: Robert A. Worrell, Sr., Chester; Richard T. Ross, Aston, both of Pa.

[73] Assignee: Scott Paper Company, Philadelphia, Pa.

[21] Appl. No.: 965,026

[22] Filed: Nov. 30, 1978

[51] Int. Cl.[2] ..... B65D 81/24

[52] U.S. Cl. ..... 206/205; 206/449; 206/607; 206/613; 206/621; 206/629; 206/812; 220/258

[58] Field of Search ..... 220/258; 206/449, 555, 206/613, 607, 629, 621, 631, 632, 633, 205, 812, 813; 229/62

[56] References Cited

U.S. PATENT DOCUMENTS

| | | | |
|---|---|---|---|
| 2,343,222 | 2/1944 | Nelson | 206/613 X |
| 2,470,388 | 5/1949 | Ball | 206/613 X |
| 3,438,565 | 4/1969 | Lugt et al. | 206/613 X |
| 3,580,466 | 5/1971 | Thelen et al. | 206/607 X |
| 3,819,043 | 6/1974 | Harrison | 206/449 |
| 3,851,762 | 12/1974 | Liblick | 206/813 X |
| 3,951,331 | 4/1976 | Smith et al. | 220/258 X |
| 4,131,195 | 12/1978 | Worrell, Sr. | 206/205 |

*Primary Examiner*—Joseph Man-Fu Moy
*Attorney, Agent, or Firm*—Martin L. Faigus; William J. Foley

[57] ABSTRACT

A flexible, moisture-impervious package for moistened webs includes a pocket portion and a flap section. The pocket portion includes an interior compartment in which the moistened webs are retained. A weakened region provided in a top wall of the pocket portion defines a plug section that is separate from surrounding sections of the top wall to form a dispensing opening through which the moistened webs can be removed. The flap section has a pressure sensitive adhesive layer on an inwardly facing surface, and this adhesive layer is adhered to the top wall in at least the plug section and the wall sections surrounding the plug section.

3 Claims, 4 Drawing Figures

FLEXIBLE AND PLIABLE MOISTURE-IMPERVIOUS PACKAGE

TECHNICAL FIELD

This invention relates to a flexible and pliable moisture-impervious package, and more specifically to a moisture-impervious package for moistened sheets and webs.

BACKGROUND ART

Premoistened sheets employed as wipers have become exceedingly popular for cleaning and/or treating adult and baby skin surfaces; in particular, the hands, face and perineal region. One reason for this popularity is that they can be used when access to washroom facilities is not readily available. For example, while traveling in automobiles; while engaging in sporting activities (e.g., tennis, golf, baseball, etc.), or while participating in camping, hiking, picnicking and related activities. For premoistened sheets to be effectively utilized in the above situations they must be packaged so that they can be transported conveniently without excessive evaporation or leakage of the moisturizing ingredients, and without becoming contaminated.

A flexible and pliable moisture-impervious package usable in the above situations is disclosed in U.S. patent application Ser. No. 859,860, filed on Dec. 12, 1977, now U.S. Pat. No. 4,131,195, and assigned to Scott Paper Company. This package includes a pocket portion in which the premoistened sheets are retained, and a flap portion joined to the pocket portion and adapted to overlie a dispensing opening extending through a flat wall of said pocket portion. In the commercial embodiment of the invention the product includes a separate moisture-impervious primary seal positioned over the dispensing opening, and the flap is adhesively fastened to the pocket portion in overlying relationship with the primary seal. In this condition the package can be stored for a long period of time without excessive loss of the moisturizing ingredients. When it is initially desired to dispense one or more sheets from the package, the primary seal is completely removed to expose the dispensing opening. Thereafter the flap portion is held in overlying relationship with the dispensing opening through a stripe of adhesive on the top wall of the pocket portion to provide the sealing function. This latter, or secondary seal is not nearly as effective in preventing moisture evaporation as the primary seal employed in the initially sold product; especially in severe conditions, such as exposure of the package to high temperatures (e.g., outdoor summer use). Therefore, a need is perceived to exist for an improved sealing arrangement, particularly after the package initially has been opened.

The '860 patent application also discloses other arrangements for establishing primary and secondary seals. However, these other arrangements either are no more effective in preventing moisture loss than the commercial embodiment, or were too difficult to form economically in a high speed mass production operation.

DISCLOSURE OF INVENTION

This invention is a flexible and pliable moisture-impervious package that prevents product contamination and that has excellent moisture-retention capabilities, even after the package initially has been opened to provide a dispensing opening for the removal of moisture-containing sheets.

In accordance with this invention the package includes a pocket portion in which premoistened sheets are retained. A weakened region is provided in an upper wall of the pocket portion to define the boundaries of a separable plug section. This plug section, when separated from the top wall, defines the dispensing opening through which the premoistened sheets can be dispensed. The package additionally includes a flap section having a pressure-sensitive adhesive layer on its inwardly facing surface. This adhesive layer is functional to overlie and adhere to the top wall of the pocket portion in both the plug section and regions circumscribing said plug section. The flap section also is adhered to a rear margin of the pocket portion to form a hinge line. As the flap section is peeled off of the top wall its adhesive connection with the plug section will be retained to separate the plug section from the top wall and thereby form the dispensing opening. To avoid undersirable tear propagation in the top wall as the plug section is being separated, the weakened region most preferably is U-shaped; with spaced-apart legs thereof extending to the rear sealed margin of the pocket portion. This arrangement causes separation of the plug section to take place along the weakened region until the rear margin is reached. The rear margin then prevents further separation, and also functions as a hinge line for the plug section. After one or more sheets are dispensed from the package the flap section can be repositioned over the dispensing opening to provide a secondary, moisture-impervious seal. This latter seal is extremely effective in retaining moisture in the package and in preventing product contamination because the inner surface of the plug section, which is free of adhesive, defines an adhesive border around it that closely circumscribes the dispensing opening. Moreover, the adhesive-free surface of the moisture-impervious plug section will overlie the dispensing opening to further aid in preventing contamination of the premoistened sheets; either with the adhesive on the flap section of the package, or with foreign matter around the package.

The above-described arrangement for establishing an adhesive border that closely circumscribes the dispensing opening is very reliable, and is more readily adaptable to formation in a mass production operation than attempting to directly apply the border of pressure sensitive adhesive to the top wall of the pocket portion in closely surrounding relationship with the dispensing opening.

BEST MODE FOR CARRYING OUT THE INVENTION

The best mode for carrying out this invention also embodies the joint invention of David Harris and Henry Stewart. The specific contribution of these latter individuals will be described hereinafter, and also is claimed in copending U.S. patent application Ser. No. 965,027, now abandoned, entitled MOISTURE-IMPERVIOUS PACKAGE, filed on even date herewith.

Figure 2:
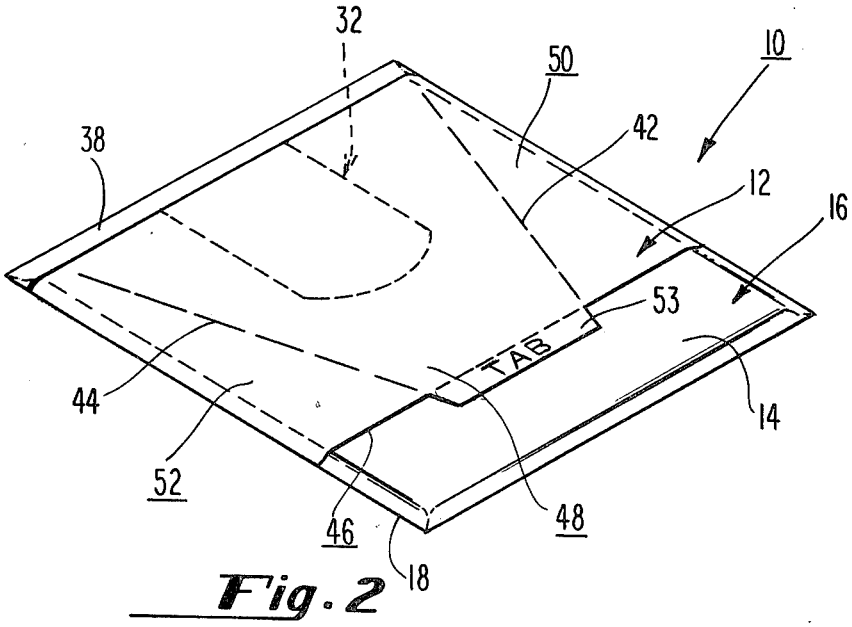
FIG. 2 is an isometric view of the completely formed package, with the flap portion adhered to the pocket portion.

Referring to FIG. 2 the flexible and pliable moisture-impervious package 10 is shown in its completed form. In this condition a flap portion 12 is adhesively secured to the top wall 14 of a pocket portion 16. The pocket portion also includes a bottom wall 18 that is heat-sealed to the top wall about the entire periphery thereof to form an interior compartment in which premoistened sheets 20 are stacked.

Both the top and bottom walls of the pocket portion 16 are provided by flexible and pliable moisture-impervious plastic sheets. In a preferred form of the invention each sheet is a laminate of polypropylene and polyethylene, and the polyethylene side of the sheets face each other and are heat-sealed together to form the pocket portion 16. Obviously at least one of the margins of the pocket portion is left open for insertion of the stack of sheets, and thereafter any opened margins are sealed.

Figure 3:
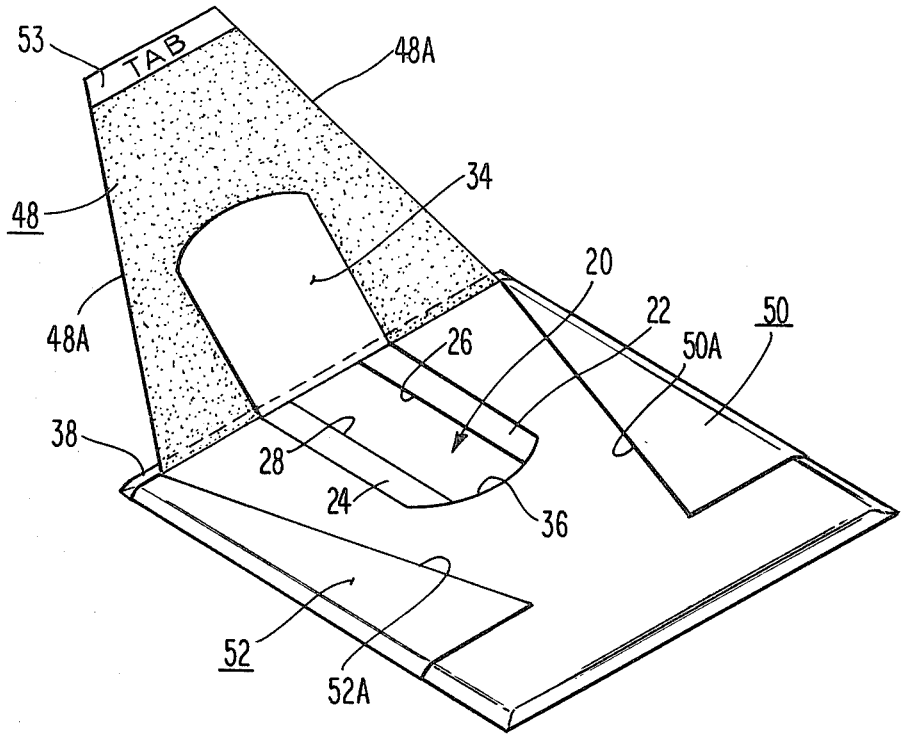
FIG. 3 is an isometric view of the package showing the relationship of elements established by lifting a section of the flap portion to form the dispensing opening through which premoistened sheets can be removed.
Figure 4:
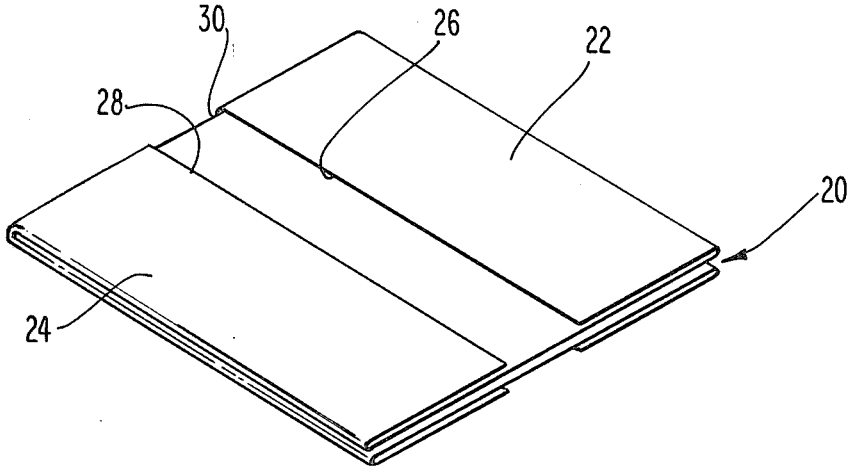
FIG. 4 is an isometric view showing one preferred arrangement of folding the premoistened sheets for retention in the package.

Referring to FIGS. 3 and 4 the premoistened sheets 20 are C-folded to form side flaps 22 and 24 that terminate in spaced relationship to each other to provide dispensing edges 26 and 28, respectively. To further reduce the overall size of the sheets they are each cross-folded about a medial line 30 extending transverse to the direction of the C-folds. The specific folding arangement employed for the sheets can be varied as desired, and is not considered to be a limitation on the broadest aspects of the invention.

Figure 1:
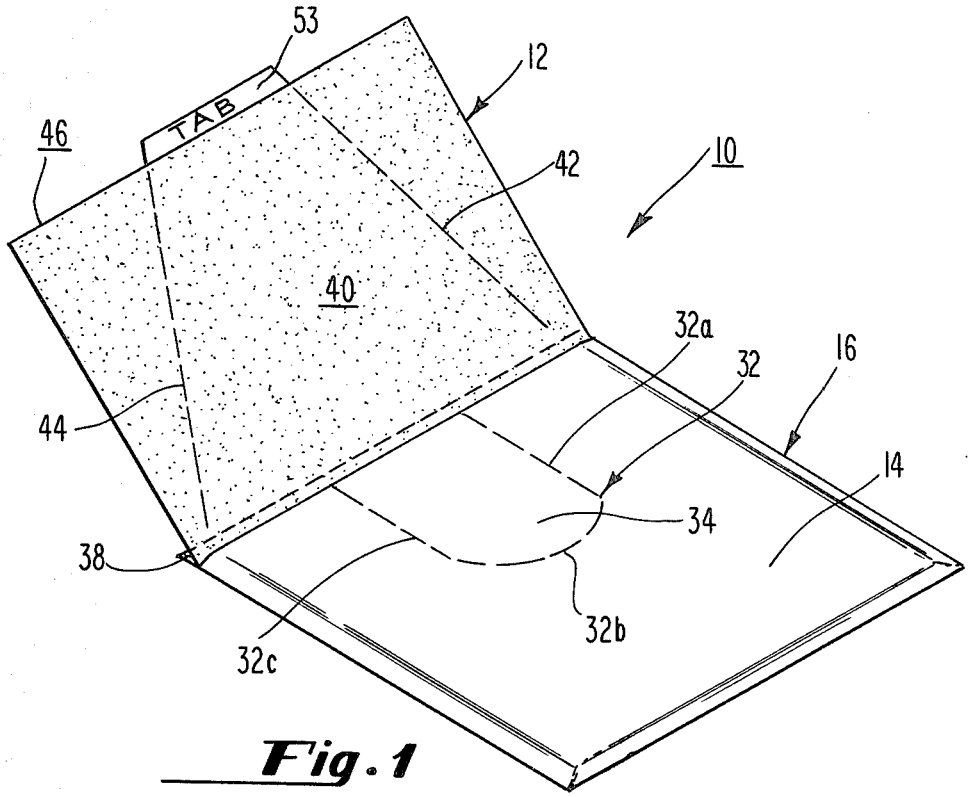
FIG. 1 is an isometric view of the flexible and pliable moisture-impervious package in an intermediate stage of formation; prior to the flap portion being adhered to the pocket portion.

Referring specifically to FIG. 1, a generally U-shaped weakened region 32, preferably in the form of perforations, is provided in the top wall 14 of the package. This weakened region defines a substantially U-shaped (or tongue-shaped) plug section 34 that is separable from surrounding sections of the top wall to provide a dispensing opening 36 through which the individual sheets 20 can be dispensed (FIG. 3). The leg-sections **32*a* of the weakened region 32 extend forwardly from the rear margin 38 of the pocket portion 16. These leg sections terminate in a generally curved base section 32*b* to complete the U-shaped weakened region. The sealed rear margin 38 acts as a hinge line for the plug section 34 when the plug section is separated from surrounding sections of the top wall along the weakened region 32**. In addition, the relationship between the weakened region and rear margin prevents undesirable tear propagation as the plug section initially is being separated from surrounding top wall sections.

By employing a molecularly oriented plastic sheet as the top wall 14 of the package, a plug section hingedly connected to the rear margin 38 can be established without undesired tear propagation, and without the necessity of separately forming a weakened region that extends all the way to said rear margin. Specifically, by positioning the sheet forming the top wall so that its molecular orientation is generally normal to the rear margin, a separate weakened region only needs to be formed in a limited section of the top wall to provide a starting point for separating the plug section. Thereafter, if this limited weakened section is properly oriented, the remainder of the plug section will be formed by tear propagation in the direction of molecular orientation in the plastic sheet. In such a molecularly oriented plastic sheet the weakened region could be perforations occupying only the section of the top wall occupied by the curved base section **32*b* of the U-shaped weakened region 32 (FIG. 1**). After separation begins along this limited perforated section, tear propagation will continue to the rear margin due to the directional weakness inherent in the molecularly oriented sheet.

Referring to FIG. 1, the flap portion 12 preferably is a sheet of conventional pressure-sensitive label stock having a pressure-sensitive adhesive layer 40 on its inner surface. The pressure-sensitive sheet forming the flap portion 12 is adhered to the top wall 14 of the pocket portion 16, and is firmly pressed against the rear margin 38 of said pocket portion to establish a strong adhesive bond that is capable of functioning as a hinge line for said flap portion. If desired, the flap portion 12 could be provided by an adhesively coated extension of the bottom wall 18 of the pocket portion 16. However, this may be less desirable than using preformed pressure-sensitive label stock because it would then be necessary to include an adhesive application step in the manufacturing process to form the adhesive layer on the inner surface of the flap.

Referring to FIGS. 1 and 2 the flap portion 12 is formed with two lines of weakness 42 and 44, preferably in the form of lines of perforations that diverge from each other in a direction from a front margin 46 of the flap portion to the sealed rear margin 38 of the pocket portion 16. These lines of perforations provide a central sealing section 48 and side guiding sections 50 and 52. The pressure-sensitive adhesive layer 40 adheres these sections of the flap portion to the top wall 14 of the pocket portion as is shown in FIG. 2.

If desired the narrow front margin 53 of the central sealing flap section 48 can be formed to be free of adhesive, and thereby provide an easily grippable tab for use in lifting the sealing section out of adhesive engagement with the top wall 14 of the pocket portion 16. Alternatively, if the entire inner surface of the flap portion 12 includes an adhesive layer, a separate tab material can be adhesively attached at the front margin to form the adhesive-free tab area.

One way of forming the tab section is to die-cut the release-liner that initially is employed to cover the adhesive layer 40 so that a band of said liner remains adhered to the flap 12 adjacent the front margin 46 thereof. The region of the side guiding sections 50 and 52 that include this band of release-liner can be die-cut from the sheet; thereby leaving an adhesive-free area only at the front margin 53 of the central sealing section 48.

When it is desired to open the package for removing one or more premoistened sheets 20, the user merely grips the forward end of the central sealing flap section 48 designated "TAB", and peels it back toward the sealed rear margin 38 of the pocket portion 16. This will cause the sealing section 48 to separate from the guiding sections 50 and 52 along the lines of perforations 42 and 44, as is seen best in FIG. 3. The adhesive attachment between the sealing section 48 and the plug section 34 will be retained to separate the plug section from surrounding sections of the top wall 14 along the substantially U-shaped perforations 32 to thereby form the dispensing opening 36. A user of the product then can grip either one of the dispensing edges 26 or 28 of a premoistened sheet 20, and pull said sheet out of the pocket portion 16. Since the plug section 34 remains attached to both the rear margin 38 of the pocket portion 16, and also to the flap portion 12, it will aid in preventing the flap portion 12 from becoming completely separated from the pocket portion when the flap section 48 is peeled back to said rear margin. In other words, the hinged connection of the plug section 34 at the rear margin 38 also acts as a hinge for the flap section 48.

To reseal the dispensing opening 36 the sealing section 48 of the flap portion 12 is repositioned over, and adhesively attached to the top wall 14 of the pocket portion 16. To accomplish the repositioning operation the side edges 48A of the sealing section 48 should be moved into close butting relationship with the inner edges 50A and 52A of the side guiding sections 50 and 52. This will insure the proper positioning of the adhesive-free inner surface of the plug section 34 into overlying relationship with the dispensing opening 36 to prevent contamination of the sheets 20 with adhesive.

Retention of the plug section 34 on the adhesive inner surface of the flap portion 12 defines an adhesive border around the plug that is adapted to closely circumscribe the dispensing opening 36. This establishes an extremely effective moisture-impervious seal after the package initially has been opened. In addition, the repositioning of the moisture-impervious plug section over the dispensing opening enhances the fluid-retaining capabilities of the package; in addition to preventing contamination from the adhesive or other foreign materials.

The lines of perforations 42 and 44 in the flap portion 12 provide a visible indicator of whether the package has been opened. Specifically, if the central sealing section 48 of the flap portion has been lifted to open the package, the lines of perforations will be broken. Otherwise the lines of perforations will be intact. This visible indicator will provide a convenient means for prospective purchasers to determine whether a particular package has been opened.

The inclusion of the lines of perforations 42 and 44 in the flap portion 12 to separate said flap portion into a movable sealing section 48 and stationary side guiding sections 50 and 52 is the joint invention of David Harris and Henry Stewart. In applicants' initial embodiment of the invention the sealing flap section was provided by the entire flap portion 12. The specific invention of David Harris and Henry Stewart was made subsequent to the generic invention covered in this application.

Although the present invention has been described with a certain degree of particularity, it is understood that the present disclosure has been made only by way of example, and that numerous changes in the details of construction and in the combination and arrangement of parts may be resorted to without departing from the scope of the invention.

What is claimed is:

1. A flexible, moisture-impervious package for moistened webs, said package including:

three flexible layers joined together to form an integral structure, two of said layers being joined to each other about their peripheries to form top and bottom flexible walls of a pocket portion in which the moistened webs are retained;

a weakened region being provided in the top wall to define a plug section, said weakened region including spaced-apart leg sections extending forwardly from adjacent a rear sealed margin of the pocket portion, said spaced-apart leg sections providing a hinge region between them adjacent said sealed rear margin, said plug section being separable along said weakened region and movable about the hinge region to form a dispensing opening in the top wall through which the moistened webs can be dispensed; and the third flexible layer constituting a flap section hingedly joined to the pocket portion at said sealed rear margin, said third layer including a pressure-sensitive adhesive layer on an inwardly facing surface thereof, said adhesive layer being continuous over an area that is sufficient to overlie the plug section and the top wall sections surrounding said plug section, said flap section being connected through said pressure-sensitive layer to the top flexible wall in at least the plug section and sections surrounding said plug section;

said flap section being movable about its hinged connection to the pocket portion to separate it from the top wall sections surrounding the plug section, and to move the plug section about its hinge region to separate the plug section along the weakened region to form the dispensing opening, said plug section remaining attached to the flap section through the adhesive layer and to the top wall of the pocket portion adjacent the rear sealed margin of said pocket portion, said plug section being adapted to be moved about its hinge region into overlying relationship with the dispensing opening when the flap section is removably connected to the top wall sections surrounding the dispensing opening through the pressure-sensitive adhesive layer.

2. The package of claim 1 wherein the third layer constituting the flap section is formed separately from the two layers forming the pocket portion, said third layer being secured to the rear sealed margin of the pocket portion to form the hinged connection.

3. The package of claim 1 wherein the third layer forming the flap section is a continuous extension of the layer that constitutes the bottom wall of the pocket portion.

* * * * *